US005368776A

United States Patent [19]

Schäfer et al.

[11] Patent Number: 5,368,776

[45] Date of Patent: Nov. 29, 1994

[54] CORROSION PROTECTION ADDITIVES BASED ON EPOXIDES

[75] Inventors: Volker Schäfer, Altrip; Robert Kohler, Oberhausen; Alfred Pauli, Sandhausen; Achim Fessenbecker, Heidelberg, all of Germany

[73] Assignee: Rhein Chemie Rheinau GmbH, Mannheim, Germany

[21] Appl. No.: 139,929

[22] Filed: Oct. 20, 1993

Related U.S. Application Data

[63] Continuation-in-part of Ser. No. 18,432, Feb. 16, 1993, abandoned.

[30] Foreign Application Priority Data

Feb. 27, 1992 [DE] Germany ..... 4206047

[51] Int. Cl.[5] ..... C23F 11/16

[52] U.S. Cl. ..... 252/395; 252/45; 252/406; 422/7; 554/92; 554/142; 562/91; 562/101

[58] Field of Search ..... 562/101, 91; 252/395, 252/406, 45; 422/7, 17; 554/92, 142

[56] References Cited

U.S. PATENT DOCUMENTS

| | | | |
|---|---|---|---|
| 2,093,576 | 9/1937 | Segessemann | 554/92 |
| 2,923,734 | 2/1960 | Sheetz | 554/92 |
| 3,097,218 | 7/1963 | Kooijaman et al. | 554/92 |
| 3,485,754 | 12/1969 | Boylan et al. | 252/56 R |
| 3,577,559 | 5/1971 | Horsley | 554/148 |
| 4,536,338 | 8/1985 | Urban et al. | 554/148 |
| 4,735,735 | 4/1988 | Borggrefe et al. | 252/33 |

OTHER PUBLICATIONS

Chemical Abstract 107(23), Abstract No. 217177a, Ogawa, Kazuo et al. "Reaction of Terminal Oxiranes with Arenesulfonic Acid".

*Primary Examiner*—Robert L. Stoll
*Assistant Examiner*—Valerie Fee
*Attorney, Agent, or Firm*—Connolly & Hutz

[57] ABSTRACT

A method for improving the corrosion inhibition of lubricating oils especially those of vegetable origin which comprises adding an efficient amount of the reaction product of an epoxidized fatty acid ester, especially an epoxidized methyl ester of an unsaturated fatty acid and a sulphonic acid and a process for producing these reaction products.

11 Claims, No Drawings

CORROSION PROTECTION ADDITIVES BASED ON EPOXIDES

This is a continuation in part of Ser. No. 08/018432, filed Feb. 16, 1993, now abandoned.

Metal objects or structures that are lubricated or protected by oils or greases frequently require an effective protection against corrosion. For this reason, an inhibitor is added to the oils or greases. This is useful with engine greases, hydraulic oils, lubricating oils, most lubricating greases and temporary rust preventatives.

In the course of time, inhibitors have been developed that act in oils or greases as oxidizing inhibitors (passivators) or as adsorption inhibitors or act simultaneously in both ways. Examples of oxidizing inhibitors are sodium nitrite or lithium nitrite, which can be finely divided as solid salts in the grease, and certain organic nitrites or chromates. The largest group of inhibitors used in oil are adsorption inhibitors, which frequently consist of nitrogen or sulphur compounds. These also include the amines, which are used either alone or as salts of the lower carboxylic acids.

The most important inhibitors used in oil are the alkali metal and alkaline earth metal salts of higher-molecular sulphonic acids, which are obtained by neutralization of sulphonated oils (petroleum sulphonates, synthetic sulphonates). These higher-molecular compounds are absorbed on the whole metal surface via their polar sulphonic acid group. Their action is in general twofold: they inhibit both the anodic and the cathodic reaction. The lipophilic part of such compounds contributes to their better solubility in mineral oils.

A disadvantage of alkaline earth metal sulphonates in combination with other additives, is that low-solubility alkaline earth metal salts can be formed which, by depositing on metal surfaces, can impair tribological efficacy. Another disadvantage is that at high processing temperatures, at which the oils vaporize or burn, inorganic salts which interfere e.g. during the rolling of very thin sheets, remain behind on the metal surfaces. It is further disadvantage that in the production of metal-containing sulphonates, heavy-metal-containing residues such as e.g. barium sulphate and zinc sulphate, arise.

The application of metal-containing corrosion inhibitors, especially in open tribological systems, is restricted since, as a result of their high metal content, the biodegradability can be inhibited with the microbial degradation process.

An object of the present invention is to provide compounds similar to sulphonates which cause good corrosion protection, when used as additives in mineral oils, greases and especially natural oil such as rape oil.

It has been found that reaction products of epoxidized fatty acids and their esters, preferably the methyl esters of such fatty acids, with higher-molecular sulphonic acids possess the required properties.

This reaction results primarily in hydroxy sulphonic acid esters (eq. 1) and after an optional heat treatment in etherification products thereof. (eq. 2)

These reactions can be demonstrated by the following equations

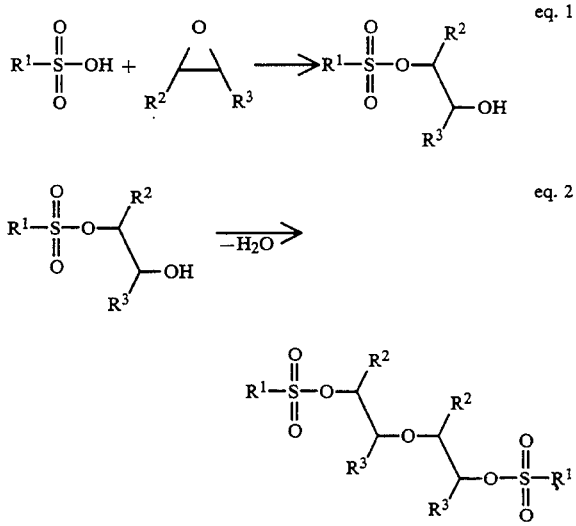

wherein $R^1$ is

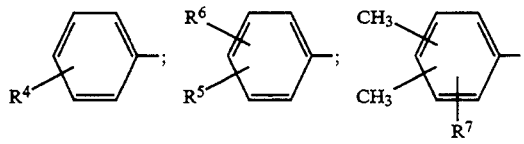

$R^4 = C_8$–$C_{30}$ alkyl; $R^5$, $R^6 = C_4$–$C_{14}$ alkyl; $R^7 = C_4$–$C_{18}$ alkyl $R^2 = HOOC—(CH_2)_n—$ $R^3 = CH_3—(CH_2)_m—$ $n+m = 6$–$20$ and $R^2$ and $R^3$ can contain additional unsaturation.

When the epoxidized fatty acid ester is a naturally occurring triglyceride of unsaturated fatty acids the reaction can be depicted as follows:

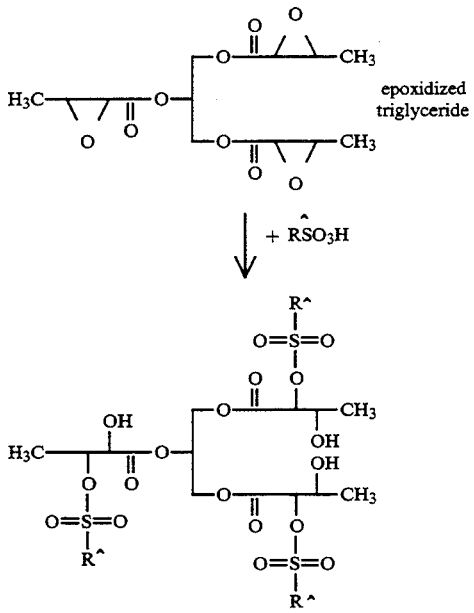

-continued

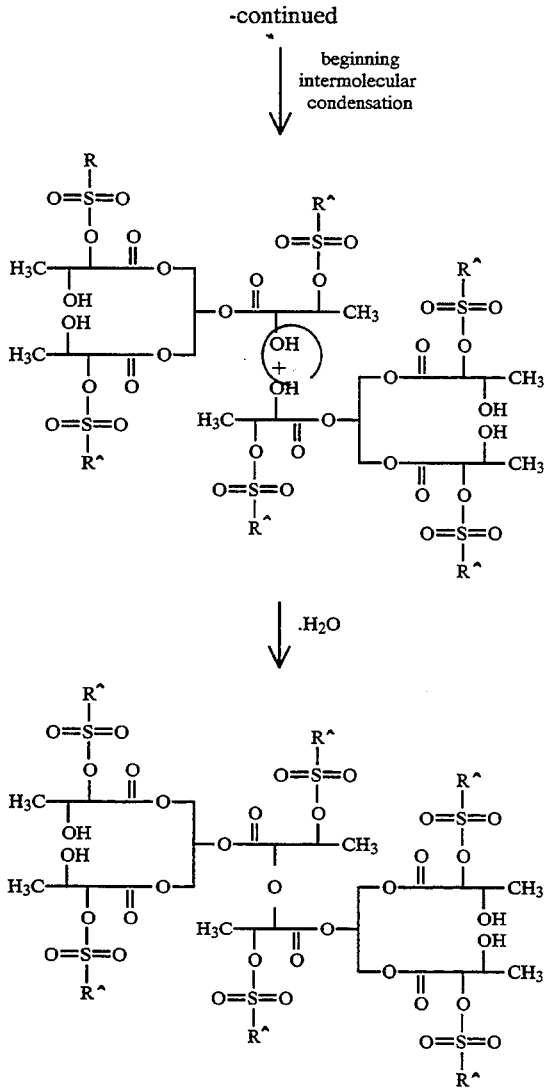

SSEKON2

This invention thus relates to a method of improving the corrosion inhibition in lubricating oils especially those of vegetable origin which comprises adding an efficient amount of the reaction product of an epoxidized fatty acid or an ester thereof, especially an epoxidized methyl ester of an unsaturated fatty acid and a low- or higher-molecular sulfonic acid.

The reaction product of the invention can be produced as follows:

Sulphonic acids suitable for the reaction are monoalkylbenzenesulphonic acids having a linear or branched $C_8$ to $C_{30}$ alkyl radical or dialkylbenzenesulphonic acids having linear or branched $C_4$ to $C_{14}$ alkyl radicals and trialkylbenzenesulphonic acids, wherein two alkyl radicals are methyl and the third is a $C_4$–$C_{18}$ alkyl radical. Example of such benzenesulphonic acids are $C_{24}$ alkylbenzenesulphonic acids, didodecyl benzene sulphonic acid, octyl xylene sulphonic acid. Fatty acids in the context of this invention are e.g. of the formula

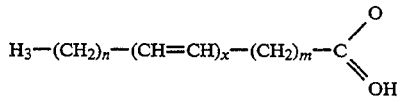

wherein n+x+m=6 to 20 and x is 1 to 4. Examples are:

9-Hexadecenoic acid (palmitoleic aic) $C_{16}H_{30}O_2$

9-Octadecenoic acid (oleic acid) $C_{18}H_{34}O_2$

Docos-13-enoic acid (erucic acid) $C_{22}H_{42}O_2$ 9,12-Octadecadienoic acid (linolenic acid) $C_{18}H_{32}O_2$ 9,12,15-Octadecatrienoc acid (linolenic acid) $C_{18}H_{30}O_2$ 5,8,11,14-Eicosatetraenoic acid (arachidonic acid) $C_{20}H_{32}O_2$.

Preferred are naturally occurring mono- or polyunsaturated carboxylic acids and mixtures thereof such as unsaturated fatty acids, as well as unsaturated fatty acid esters (such as methyl, butyl, 2-ethylhexyl esters) and triglycerides, i.e. natural fats and oils can be used. These products are epoxidized so that they have an epoxide content of 1.5 to 15% by weight (% by weight oxygen relative to epoxidized methyl ester) preferably 4 to 8% by weight. They are reacted with the sulphonic acids in an amount of 10 to 60% by weight (relative to epoxidized fatty acid ester) at a temperature of from 20° to 120° C., preferably 30° to 60° C. to form liquid products. The amount of sulphonic acids is selected so that there is about one mol of reactive sulphonic acid group to one mol of epoxide groups. If the reaction is not completely stoichiometric, the reaction product should preferably still contain epoxide groups. Preferred sulphonic acids are higher-molecular dialkylbenzenesulphonic acids.

The reaction products obtained are added to oils, especially natural oils, in amounts of 0.01–70 wt %, preferably 0.05 to 5% by weight, based on pure oil, and provide the latter with considerably better corrosion protection properties than conventional corrosion inhibitors such as metal sulphonates and metal naphthenates.

Depending on the sulphonic acid and epoxidized fatty acid methyl esters used, demulsifying as well as emulsifying products can be obtained. The use of lubricants with above all good demulsifying behaviour is required, in particular for hydraulic, gear and steam turbine oils for which HLP and CLP requirements are prescribed.

Hydraulic oils HLP according to DIN 51524 part 2 are pressure liquids of mineral oils with additives for improving corrosion inhibition, resistance to ageing and for reducing abrasion.

Lubricating oils CLP according to DIN 51524 part 3 are mineral oils with additives for improving corrosion inhibition, resistance to ageing and additives for reducing abrasion.

To prevent upsets occuring in hydraulic plants, hydraulic oils must be readily filterable through extremely fine filters (e.g. 3 μm). The reaction products according to the invention, unlike conventional sulphonates do not contain metal compounds which often interfere with the filterability or even make it impossible to filter the oils. When using a sulphonate which is free of metals, such difficulties are not encountered. The result is that of extremely good filtration characteristics.

The reaction products according to the invention are suitable as additives to dewater fluids based on low-boiling hydrocarbons because of their water-repellent and corrosion protection properties.

Because of their high affinity for rapidly biodegradable base oils such as rape oil, soya oil and synthetic esters, they are suitable additives for the formulation of rapidly biodegradable lubricants. As a result of the use of epoxidized natural raw materials and the absence of metal ions, their biodegradability is considerably better than that of the conventional additives, e.g. metal sulphonates.

EXAMPLE 1

500 g $C_{24}$ monoalkylbenzenesulphonic acid containing about 30% by weight of hydrocarbon contaminants with an acid number of 79 mg KOH/g substance and 300 g rape oil are heated with stirring to 40° C. To it 400 g epoxidized rape oil with an epoxide content of 5 wt % are added in portions over 60 min. Subsequently, the mixture is allowed to react further for 4 hours at 40° C. The reaction product obtained can be used without further processing as corrosion protection additive.

EXAMPLE 2

500 g didodecylbenzenesulphonic acid containing about 30% by weight of hydrocarbon contaminants with an acid number of 80 mg KOH/g substance and 300 g rape oil are heated with stirring to 40° C. To the mixture 195 g 2-ethylhexylglycidyl ether are added in portions over 60 min. Subsequently, the mixture is allowed to react further for 4 hours at 40° C. The reaction product obtained can be used without further processing as corrosion protection additive.

EXAMPLE 3

500 g epoxidized rape oil acid methyl ester with an epoxide content of 5 wt % are heated to 40° C. To it 660 g monoalkylbenzenesulphonic acid of example 1 are added in portions over 60 min. Subsequently, the mixture is allowed to react further for 4 hours at 40° C. The reaction product obtained can be used without further processing as corrosion protection additive.

We claim:

1. In a method of corrosion inhibition of a lubricating oil wherein the improvement comprises adding to the lubricating oil a corrosion-inhibiting amount of the reaction product of an epoxidized fatty acid ester and an alkylbenzene sulfonic acid.

2. A method according to claim 1, wherein the lubricating oil contains 0.01 to 70% by weight of the reaction product based on weight of the lubricating oil.

3. A method according to claim 1, wherein the lubricating oils are of vegetable origin.

4. A method according to claim 1, wherein the epoxidized fatty acid ester is a methyl ester of an unsaturated fatty acid.

5. The method of claim 1, wherein the reaction product is formed by reacting an epoxidized fatty acid or its ester containing 1.5 to 15% by weight of epoxide with a monoalkylbenzenesulfonic acid, a dialkylbenzenesulfonic acid or a trialkylbenzenesulfonic acid at 20° to 120° C., the benzenesulfonic acid being reacted in an amount which provides 1 mol of reactive sulfonic acid groups per mol of epoxide groups in the epoxidized fatty acid or its ester.

6. A process for manufacturing modified fatty acids and esters thereof which comprises reacting an epoxidized fatty acid or its ester containing 1.5 to 15% by weight of epoxide with a monoalkylbenzenesulfonic acid, a dialkylbenzenesulfonic acid or a trialkylbenzenesulfonic acid in an amount such that 1 mol of reactive sulfonic acid groups is provided per 1 mol of epoxide groups at a temperature of 20° to 120° C.

7. A lubricating oil which contains, as a corrosion inhibitor, the reaction product of an epoxidized fatty acid or ester with a benzenesulfonic acid.

8. A lubricating oil as claimed in claim 7, wherein the reaction product is the reaction product of an epoxidized fatty acid or ester reacted with a monoalkylbenzenesulfonic acid, a dialkylbenzenesulfonic acid or a trialkylbenzenesulfonic acid at 20° to 120° C.

9. A lubricating oil as claimed in claim 7, wherein the oil contains 0.01 to 70% by weight of the reaction product.

10. A lubricating oil as claimed in claim 7, wherein the oil contains 0.05 to 5% by weight of the reaction product.

11. A lubricating oil as claimed in claim 7, wherein the oil is a vegetable oil.

* * * * *